US005353049A

United States Patent [19]

Ro et al.

[11] Patent Number: 5,353,049

[45] Date of Patent: Oct. 4, 1994

[54] PAPER HOLDER OF VIDEO PRINTER

[75] Inventors: Kwang-Ho Ro; Moon-Bae Park, both of Suwon, Rep. of Korea

[73] Assignee: SamSung Electronics Co., Ltd., Suwon, Rep. of Korea

[21] Appl. No.: 878,522

[22] Filed: May 5, 1992

Related U.S. Application Data

[63] Continuation-in-part of Ser. No. 808,726, Dec. 17, 1991, abandoned.

[30] Foreign Application Priority Data

Jan. 12, 1991 [KR] Rep. of Korea ..... 367/1991

[51] Int. Cl.[5] ..... B41J 11/02

[52] U.S. Cl. ..... 346/138; 346/101; 346/76 PH

[58] Field of Search ..... 346/76 PH, 138, 1.1; 400/120; 271/275, 277

[56] References Cited

U.S. PATENT DOCUMENTS

| | | | |
|---|---|---|---|
| 4,661,826 | 4/1987 | Saitow | 346/76 PH |
| 4,717,270 | 1/1988 | Tsutsumi | 346/76 PH |
| 4,815,870 | 3/1989 | Sparer et al. | 400/120 |
| 5,026,180 | 6/1991 | Tajima et al. | 346/138 |
| 5,092,698 | 3/1992 | Narui et al. | 271/277 |
| 5,168,287 | 12/1992 | Okunomiya et al. | 346/138 |
| 5,196,869 | 3/1993 | Park | 346/138 |

FOREIGN PATENT DOCUMENTS

| | | |
|---|---|---|
| 0272802 | 6/1988 | European Pat. Off. . |
| 0340925 | 11/1989 | European Pat. Off. . |
| 0403775 | 12/1990 | European Pat. Off. . |

*Primary Examiner*—Benjamin R. Fuller
*Assistant Examiner*—N. Le
*Attorney, Agent, or Firm*—Robert E. Bushnell

[57] ABSTRACT

A paper holder assembly has an axle coaxially positionable to extend axially outwardly from axially opposite bases of a platen drum providing a circumferential outer surface disposed between the opposite bases, the axle has circumferential grooves terminated by corresponding flanges. A pair of brackets each having three arms joined together in a unitary monolithic structure with first and second arms defining a centrally disposed recess having spaced-apart curved sides are positioned to ride along corresponding ones of the circumferential grooves. A pivot pivotally connects the second arms to the opposite bases of the platen drum, and a paper holder extending from the distal portion of the third arm holds edges of sheets of paper against the circumferential outer surface projecting axially inwardly from distal ends of the third arms across the circumferential outer surface. Springs bias the bracket toward a first orientation relative to the pivot. Rotating the brackets and paper holder against the bias springs releases the leading edge of the paper from the platen drum; by discharging a paper under frictional force just after completion of printing of the last color, a substantial length of a ribbon is saved by advancing the ribbon only for printing. Thus, when printing a third color after printing the first and second colors, the rotation of the paper holder enables the partially printed paper to be lifted away from the platen by its intrinsic resilient force. As a result, printing of the last color is performed simultaneously with discharging of the completely printed paper.

40 Claims, 12 Drawing Sheets

PAPER HOLDER OF VIDEO PRINTER

CROSS REFERENCE TO RELATED APPLICATION

This application makes reference to and claims the benefits available under Title 35 U.S.C. §§119 and 120 as a continuation-in-part of a U.S. patent application earlier filed in the U.S. Patent & Trademark Office on Dec. 17, 1991 and assigned Ser. No. 07/808,726 abandoned.

BACKGROUND OF THE INVENTION

The present invention relates to a method discharging paper in a video printer, and more particularly, to a method for increasing printing speed with high picture quality in the paper holder of a video printer.

Generally, a video printer is used to print pictures recorded by momentarily acquiring a video signal and the picture to be reproduced on a monitor through a recording device such as a still camera. There has previously been disclosed a method of heat conductive sublimation for sublimating each of these colors of yellow (Y), magenta (M) and cyan (C) successively; this method enables a gradation of the color to be expressed freely, thus enabling expression with all of the colors from the video signal.

In conventional, commercially available multi-color printers, the platen drum must necessarily rotate after completion of printing in order to discharge the completely printed paper. In some models, even the direction of platen drum rotation must be reversed to be discharged. Generally, in currently available multi-color printers, to assure rotation of the completely printed paper during the discharge rotation of the platen drum, the thermal print head is positioned to press the printed paper and a portion of the dye-beating color ribbon against the platen drum. This portion of the dye-beating ribbon adjoins the three-color array of dyes used to print the paper, and is itself not necessary for printing of the paper. Consequently, the currently available printers and their processes require an additional length of ribbon solely to accommodate the frictional force required to be used between the platen, paper, ribbon and thermal print head during the final steps of advancing the finished paper toward discharge. In order to engage the additional portion of the ribbon however, the platen drum must rotate incrementally by the length of the additional portion of the ribbon, thereby further slowing the printing process. In summary, currently available printers and multi-color printing processes are unnecessarily wasteful of ribbon material and time.

SUMMARY OF THE INVENTION

It is one object of the invention currently disclosed invention to provide an improved process and apparatus for performing multi-color printing.

It is another object to provide a process and apparatus for reducing printing time by applying frictional force to a paper simultaneously with the completion of the printing of the last color from a multi-color ribbon, to thereby advance the printed paper toward discharge.

It is a further object to provide a process and apparatus for reducing the length of a color ribbon required for multi-color printing by discharging the printed paper immediately upon completion of the printing of the last color.

It is a still further object to provide a process and apparatus capable of simplifying the structure of the bracket and the paper holder in multi-color printers and in multi-color printing processes.

In accordance with the present invention, a process and apparatus, for printing yellow, magenta and cyan colors in sequence by using a video printer. The apparatus uses an axle coaxially positionable to extend axially outwardly from axially opposite bases of a platen drum providing a circumferential outer surface disposed between the opposite bases, the axle having circumferential grooves terminated by corresponding flanges, a pair of brackets each having first, second and third arms joined together in a unitary monolithic structure with the first and second arms defining a centrally disposed recess having spaced-apart curved sides positioned to ride along corresponding ones of the circumferential grooves, a pivot for pivotally connecting the second arms to the opposite bases of the platen drum, and a paper holder for holding edges of sheets of paper against the circumferential outer surface. The paper holder of each bracket projects axially inwardly from distal ends of the third arms across the circumferential outer surface. A pair of springs biases each of the brackets toward a first orientation relative to the pivot.

The process contemplates the steps of:

- inserting a leading edge of a sheet of paper between a side surface of a platen drum and a paper holder, and holding the leading edge along opposite sides;
- rotating the platen drum in a counter-clockwise direction to advance the paper to a first position along the platen drum, the first position being sensed by a counter;
- stopping rotation of the platen drum and actuating a head motor to lift a thermal print head from the platen drum;
- rotating the platen drum in a counter-clockwise direction until the paper is delivered to a second position sensed by the counter;
- stopping rotation of the platen drum, and actuating the head motor to impress the paper with the thermal print head;
- rotating the platen drum in a counter-clockwise direction and heating the thermal print head to thereby print a first color from a multi-colored ribbon onto the paper until the paper is delivered to the first position;
- stopping the platen drum, lifting the thermal print head, and rotating the platen drum while the paper moves from the first position to the second position;
- stopping the platen drum, applying the thermal print head to press the paper against the platen, and heating the thermal print head while the paper is in the second position, to thereby print a second color from the ribbon onto the paper as the platen drum resumes rotation to move the paper to the first position;
- lifting the thermal print head and rotating the platen drum while the paper is moved from the first position to the second position after stopping the platen drum;
- stopping rotation of the platen drum and the head motor;
- actuating means for lifting the paper holder away from the platen drum at the second position, and thereby releasing the leading edge of the printed paper from the side surface of the platen drum;

stopping the driving means to enable the paper holder to engage the platen drum;

rotating the platen drum in a counter-clockwise direction, actuating the motor and heating the thermal print head and thereby printing the last color from the multi-colored ribbon and discharging the completely printed paper just after the printing of the last color.

BRIEF DESCRIPTION OF THE DRAWINGS

A more complete appreciation of this invention and many of the attendant advantages thereof will be readily apparent as the same becomes better understood by reference to the following detailed description when considered in conjunction with the accompanying drawings in which like reference symbols indicate the same or similar components, and wherein.

DETAILED DESCRIPTION OF PREFERRED EMBODIMENTS

Figure 1:
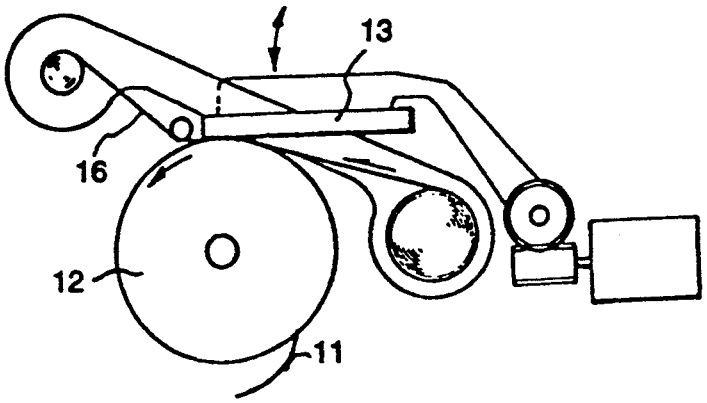
FIG. 1 (PRIOR ART)
FIG. 1 is a schematic diagram of a conventional video printer.

Turning now to the drawings, FIG. 1 shows a video printer with an ink bearing ribbon 10 containing a dye of three consecutively arranged colors arranged, for example, is a sequence of yellow (Y), magenta (M) and cyan (C), a heat sensitive record medium paper such as a sheet of commercially available cut sheet or fan-fold paper 11, a platen drum 12 for moving the heat sensitive paper 11 and the ink bearing ribbon 10, and a thermal printing head (T.P.H.) 13 for selectively pressing the ribbon 10 and paper 11 against the platen drum 12.

If the platen drum 12 rotates after fixing paper 11 onto its outside surface, paper 11 and ink ribbon 10 advance at the speed of the platen drum 12. Each of the dyes Y, M and C is sublimated by the heat value generated by the thermal printing head 13, and is absorbed on paper 11. Different rates of the absorbed dyes Y, M and C of the ink borne by the ribbon enables various synthesized colors to be printed on paper 11 with different gradations so that the printing of all kinds of colors is made possible.

Figure 2:
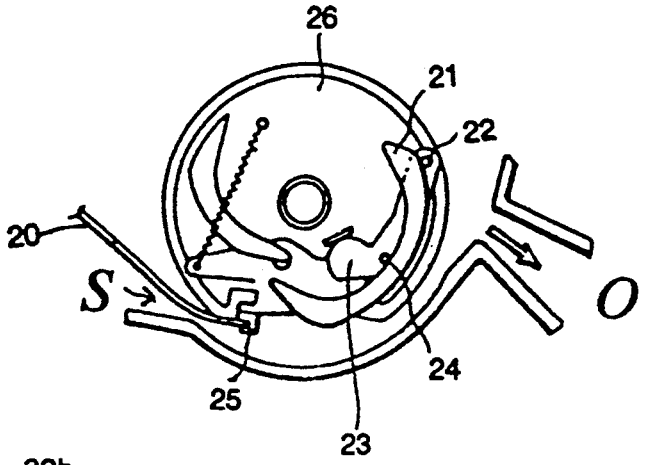
FIG. 2 (PRIOR ART)
FIG. 2 is a schematic diagram of a conventional paper holder and a bracket of a video printer.

A device disclosed in U.S. Pat. No. 4,815,870 by Steven J. Sparer and William I. Morris, which is assigned to the Eastman Kodak Company of Rochester, N.Y., is shown in FIG. 2. Heat sensitive paper 20 is supplied through the supplying port S to a clamp 25. A bracket 23 is rotated around a rotating axis 24 by a projecting pin 22 to ride against an outside surface of a cam 21, with the result that clamp 25 presses against paper 20.

In printing of the Y, M and C ink dyes, platen drum 26 rotates counter-clockwise to complete the printing of the selected Y, M and C colors, by rotating three times. Platen drum 26 continuously rotates in a counter-clockwise direction so that the tip of paper 20 is delivered to an entrance of a discharging port 0. Thereafter, the platen drum 26 rotates clockwise to discharge paper 20. At the time of discharge, clamp 25 releases paper 20 through action of cam 21.

As shown in FIG. 2, the supply port S and discharge port O are installed in approximately radially opposite directions from each other. Thus, the platen drum 26 rotates in a counter-clockwise direction in order to print the Y, M and C dyes. In order to discharge the completely printed paper (not shown), the platen drum 26 rotates counter-clockwise until the leading edge of paper 20 reaches the tip of the discharging port O, and thereafter the platen drum 26 rotates counter-clockwise to discharge the printed paper.

Accordingly, in the configuration shown in FIG. 2, in addition to actual printing time required for printing of the Y, M and C dyes, more time is required for rotating the platen drum counter-clockwise so as to position the completely printed paper at the entrance of the discharging port O, and additional time is then required for rotating the platen drum clockwise to discharge the paper. Also, installation of a mechanism for rotating the platen drum in both directions is inevitable.

Figure 3:
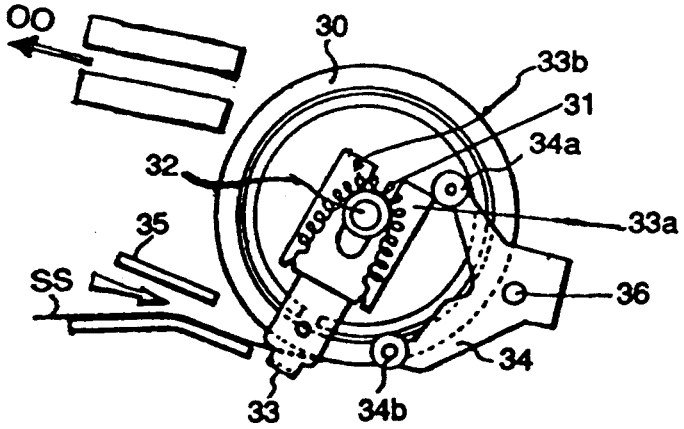
FIG. 3 (PRIOR ART)
FIG. 3 is a schematic diagram of another conventional paper holder and a bracket of a video printer, for addressing problems of the device of FIG. 2.

As shown in FIG. 3, there has previously been disclosed a holder for fixing or releasing paper 35 on or from the platen drum, wherein the holder 33 is installed around a shaft 31 of the platen drum 30, which is held around shaft 31 by a spring 32. A clamp bracket 34 actuates a side end of the holder 33 so as to let the holder fix or release the paper.

Paper 35 is transferred through a supply port SS to a front of holder 33. Bracket 34 is rotated around a shaft 36 counter-clockwise by a driving part (not shown) so that one arm 34*a* of bracket 34 pushes one arm 33*a* of holder 33. Therefore, holder 33 is lifted from the surface of platen drum 30 so as to receive paper 35. The voltage supply of the driving part (not shown) is then stopped so that bracket 34 returns to its original position under a restoring force of spring 32, with the result that holder 33, in unison with bracket 34, presses against, and thereby secures the position of paper 35 against drum 30.

In the device shown in FIG. 3, during the printing of the Y, M and C dyes, platen drum 30 rotates counter-clockwise. In order to discharge the completely printed paper after printing, platen drum 30 should rotate somewhat additionally until the holder 33 reaches the entrance of discharge port OO. Then, platen drum 30 rotates clockwise, the other arm 34*b* of bracket 34 pushes the other arm 33*b* of holder 33, and holder 33 is detached from platen drum 30. Accordingly, the forward tip of the completely printed paper is released, thereby discharging the print-completed paper. At this time, the thermal print head (not shown) should press the printed paper to create a frictional force between the paper, the ribbon dye, and the platen drum.

Figure 4A:
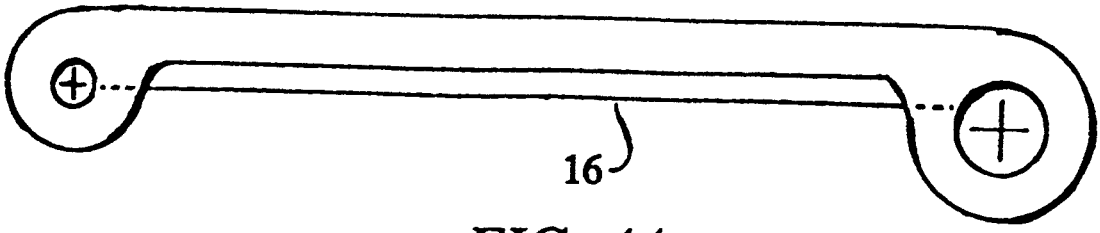
FIG. 4A (Prior Art)
FIG. 4A and 4B are schematic diagrams illustrating a color ribbon cassette and the pattern of the color ribbon in a cassette suitable for the device of FIG. 3.
Figure 4B:
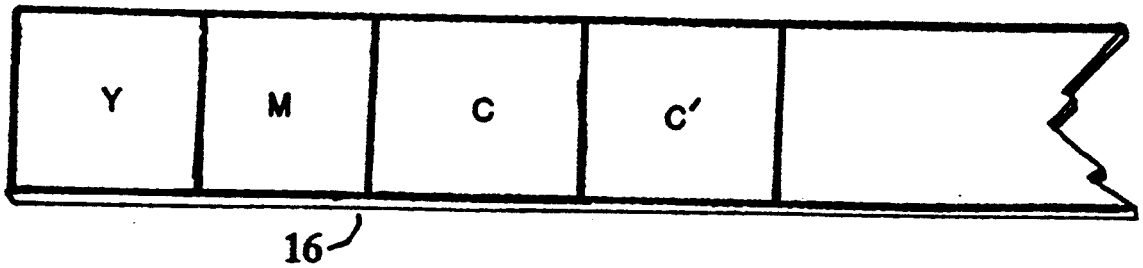
FIG. 4B (Prior Art)

FIG. 4A illustrates the conventional structure of a cassette for the ink bearing ribbon shown in FIG. 4B, which has a consecutive series of patterns each containing the yellow (Y), magenta (M) and cyan (C) color dyes. Conventional video color printers such as represented by FIGS. 1, 2 and 3, first print yellow, next print magenta, and finally print cyan after conforming the position of the paper at an initial printing position for the previous color, in order to thereby complete printing of one multi-color picture.

The platen drum of conventional multi-color printing devices should rotate somewhat in order to discharge the paper after completion of the printing of one picture under a scheme in which the thermal print head presses the record paper and region C of the ink ribbon. Consequently, region C' of the cyan dye C on the ribbon is wasted. That is, in addition to the actual ribbon region of the dyes required for printing of one picture, the additional ribbon region C' is then consumed by the frictional engagement during the paper discharge steps. Also, because the platen drum should rotate further by the length of ribbon region C', printing speed is slow. In short, the device of FIG. 3 wastes printing time and ribbon material.

Figure 5:
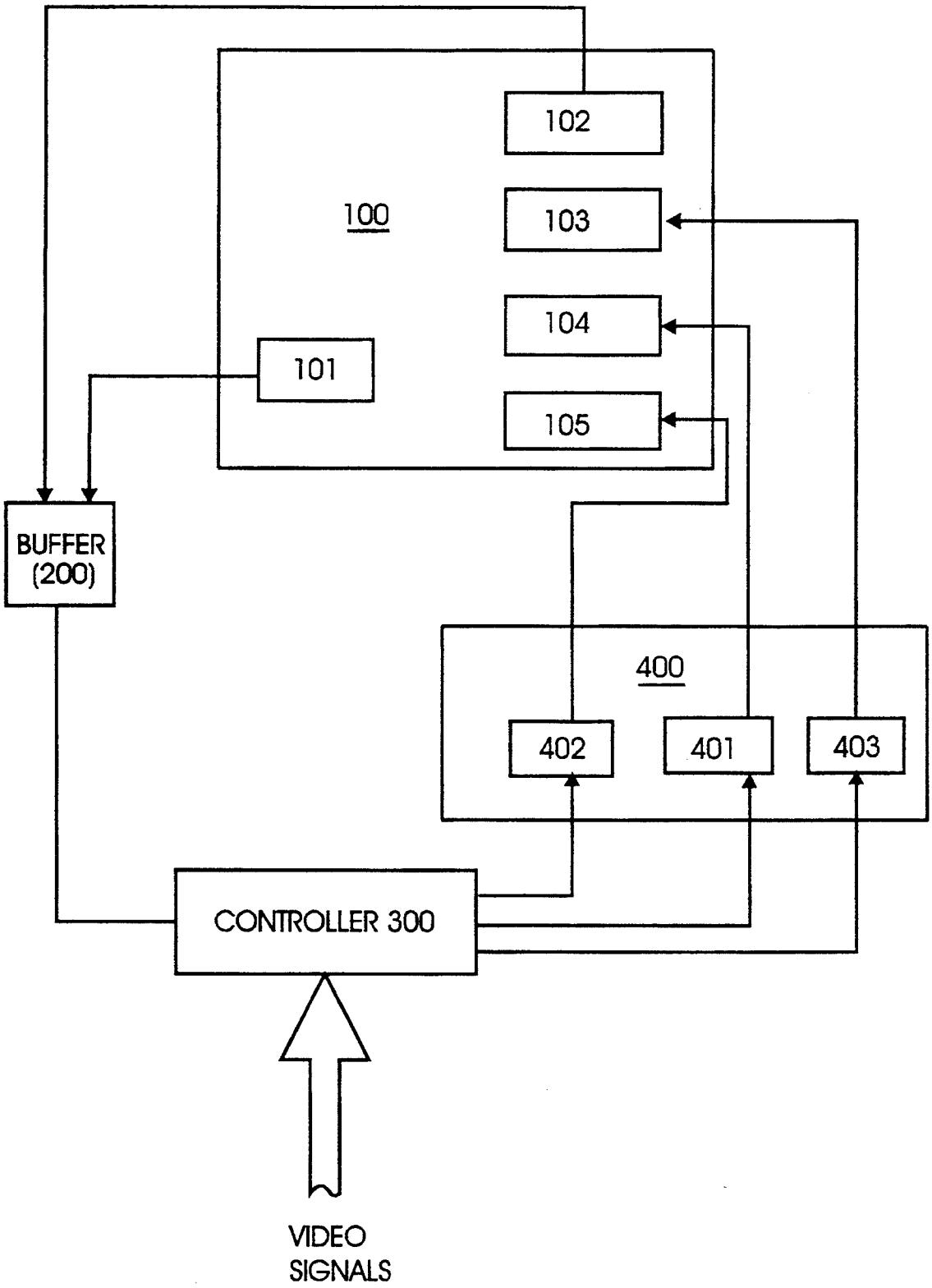
FIG. 5 is block diagram for a video color printer constructed according to, the principles of the present invention.

Referring now to FIG. 5, a device constructed to address the deficiencies of convention printers is illustrated. This device has a paper holder with a mechanism assembly 100, a buffer 200, a controller 300 and a mechanism driver 400. Mechanism assembly 100 includes a paper sensor 101, a print head contact sensor 102, a thermal printing head 103 heated according to concentration and density of color of the picture to be printed, a flange 104 for driving a bracket (not shown), and a platen drum 105 for moving the paper in the printing processes.

The record paper sensor 101 senses whether paper has been introduced through a supply port (not shown). Head contact sensor 102 detects the distance between the platen drum and the thermal print head when the head is lifted away from the platen drum. Sensory signals from sensor 101 indicating whether paper has been inserted into the supply port, and from sensor 102 indicating the distance between the thermal print head and the surface of the platen drum, are transmitted to buffer 200.

The controller 300 receives video signals for printing of video images, and controls the mechanism assembly 100 according to the sensory signals. A counter of controller 300 counts line numbers, and thereby enables sensing of the distance by which the paper moves along the circumference of platen drum 105. In dependence upon control signals from the controller 300, mechanism driver 400 drives the mechanism assembly 100. Driver 400 has a platen drum motor 402 for driving platen drum 105, a solenoid 401 for driving flange 104, and a head motor 403 for driving thermal print head 103.

Figure 6:
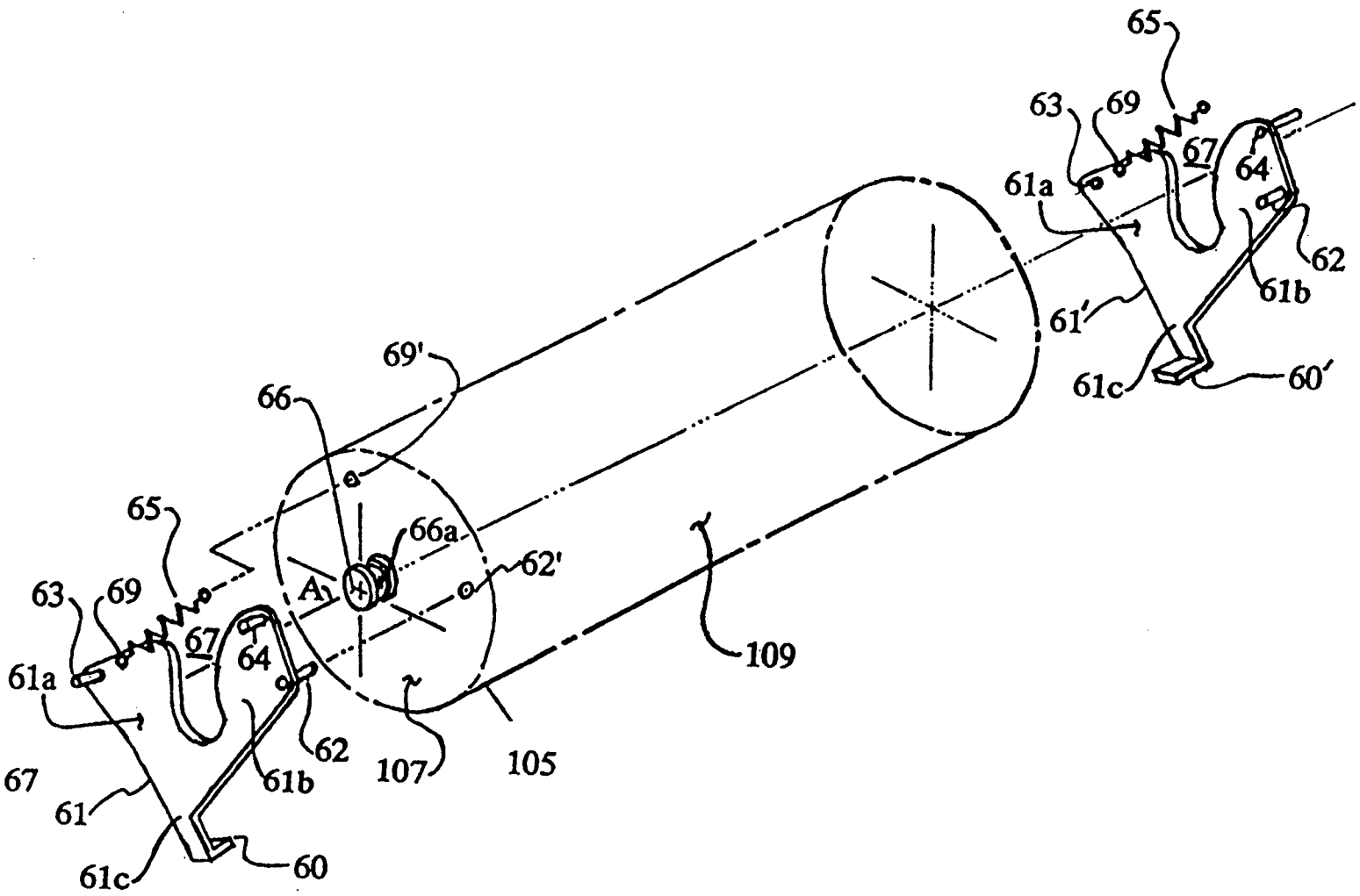
FIG. 6 is an exploded perspective view of the paper holder and the bracket for a device constructed to incorporate the features of the embodiment of FIG. 5.

FIG. 6 is a detailed drawing of a pair of brackets 61, 61' with paper holders 60 installed adjacent the opposite ends of platen drum 105 of FIG. 5. Left and right brackets 61, 61' that are connected to both opposite base ends 107 respectively, so as to rotate around an axle 62 formed in each bracket 61, 61'. Each bracket 61, 61' has first **61*a*, second 61*b*, and third arms 61*c* joined together in a unitary, monolithic structure. The first and second arms 61*a*, 61*b* of each bracket define a centrally disposed recess 67 having spaced-apart curved sides positioned to ride along corresponding circumferential grooves 66*a* in each axle 66 of platen drum 105. Each pivot 62 is received into a corresponding conforming aperture 62' in the corresponding base 107 of drum 105. Pivots 62 and pins 63, 64 project from bracket 61. Thus, a distal end flange 104 of a solenoid 410 (see FIGS. 7B, 7G) may contact pins 63, 64 and thereby rotate bracket 61 around pivot 62. Springs 65 are installed between point 69 of one arm 61*a* of bracket 61 and aperture 69' in the bases 107 of drum 105 so as to individually impose restoring forces on arms 61*a* of brackets 61 and the opposite bases 107 of the platen drum, thus pulling the paper holder 60, 60' toward the circumferential surface 109 of the platen drum 105. Curved recess 67 formed into the surface of bracket 61, accommodates, and is guided by, a ranged circumferential recess 66*a* of a shaft 66 coaxially extending from axially opposite bases of platen drum 105 as paper holder 60, 60' is moved toward, or from, platen drum 105. During movement of bracket 61 about pivot 62, a curved centerline of recess 67 travels along the axis "A" of axle 66 as the opposite curved surfaces of recess 67 ride along recess 66*a*. In one design, the curved sides of recess 67 define arcs of different radii having centers substantially coincidental with pivot 62, and paper holders 60, 60' define an arc having a center substantially coincidental with pivot 62 and a radius greater than the different radii defined by the curved sides of recess 67, as paper holders 60, 60' travel from a first orientation (see, e.g., FIG. 7A) where paper holders 60, 60' engage the circumferential surface 109, and around pivot 62 relative to opposite bases 107, to a second orientation (see, e.g., FIG. 7B) where paper holders 60, 60' are spaced apart from the circumferential surface 109**.

Figure 6A:
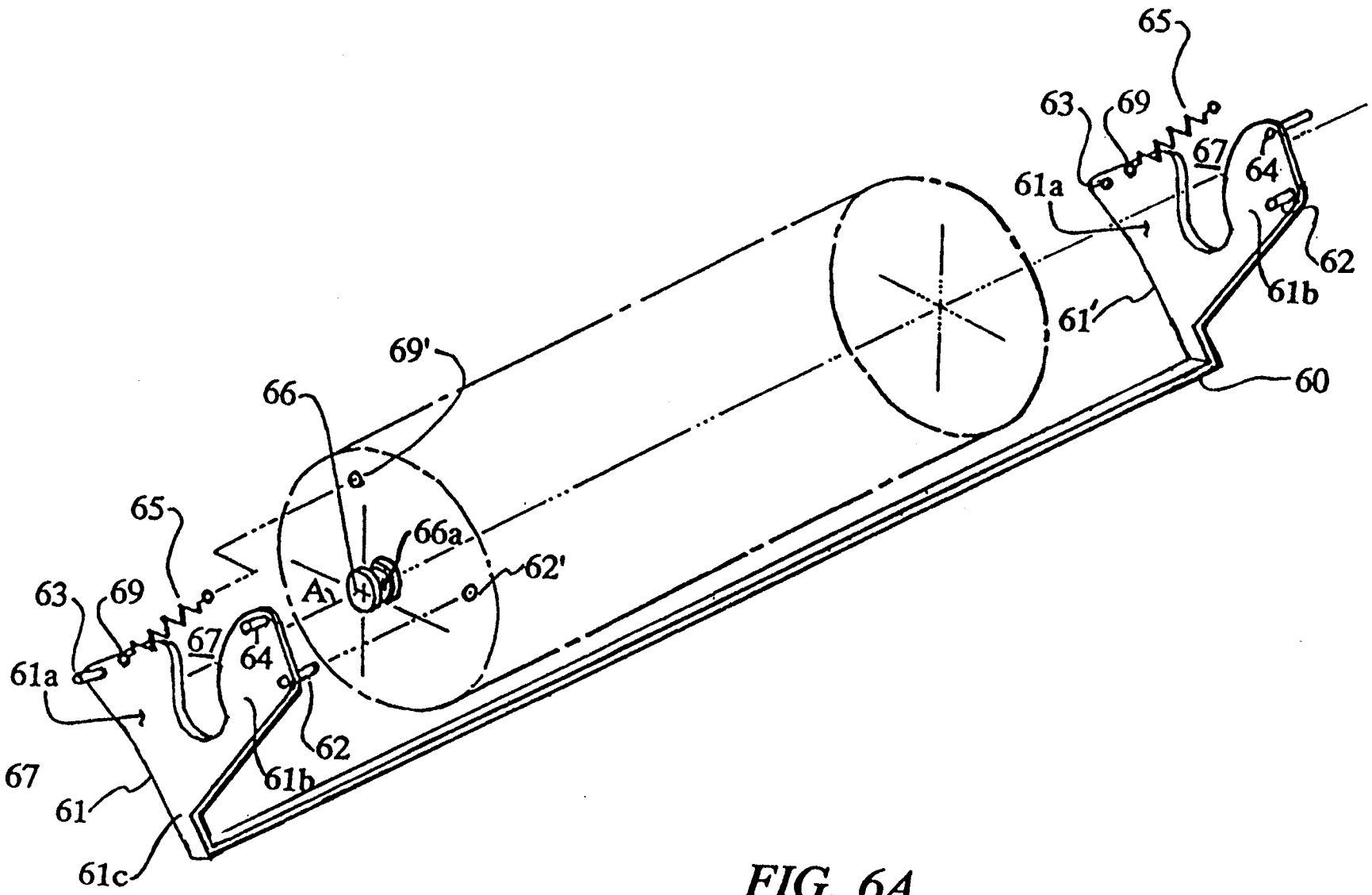
FIG. 6A is an exploded perspective view of an alternative embodiment of the paper holder and bracket.
Figure 6B:
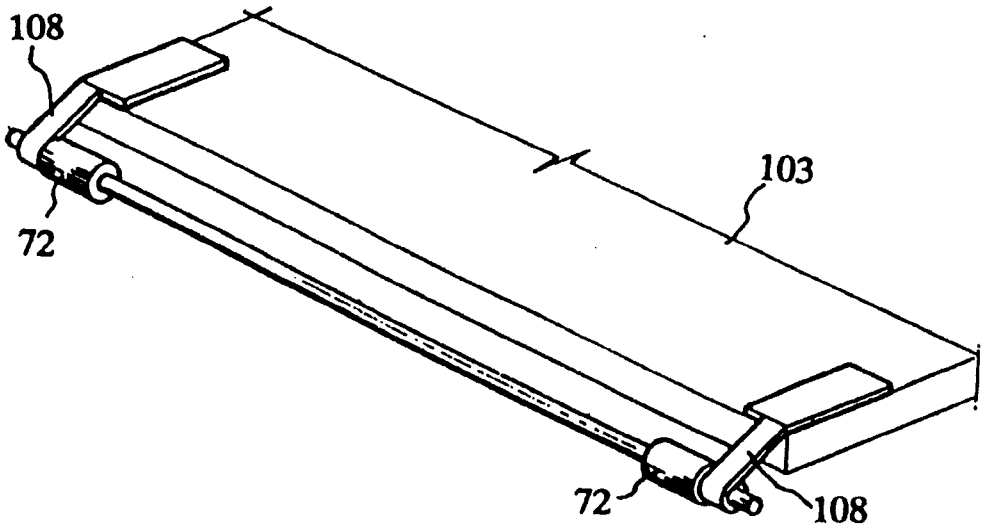
FIG. 6B is a perspective view of a print head assembly.

FIG. 6B illustrates a thermal print head 103 with a pair of spaced-apart brackets 108 holding a shaft supporting a pair of rollers 72.

The operation of one embodiment of the present invention can be described with reference to FIGS. 7A through 7H.

Figure 7A:
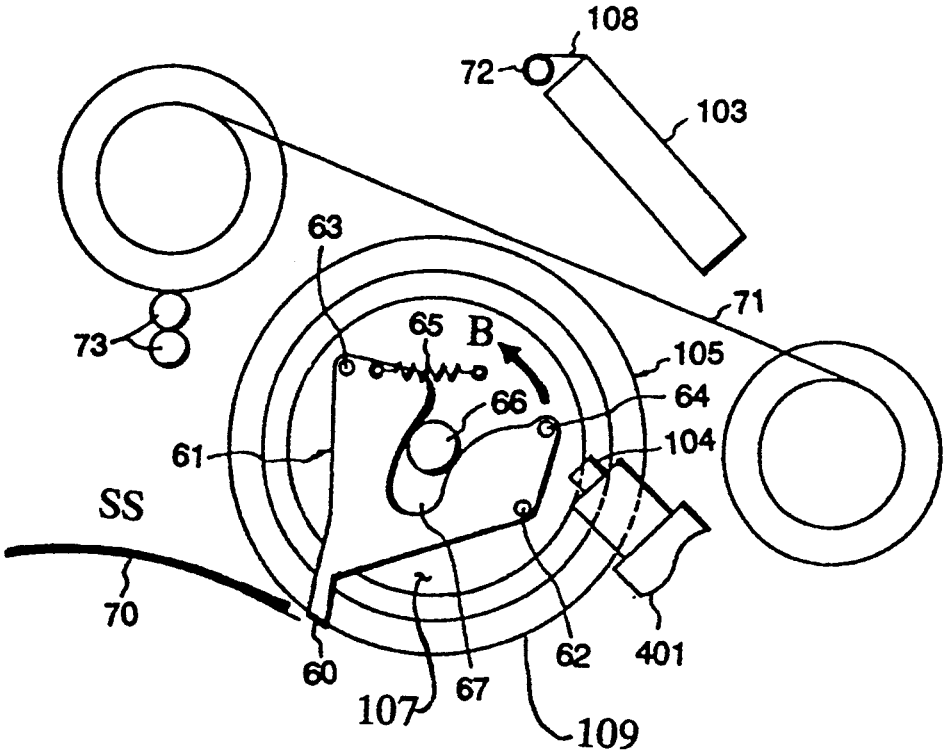
FIGS. 7A to 7H are operational diagrams illustrating a sequence of relative portions of a paper holder of the inventive video printer constructed and operated according to the principles of the present invention.
Figure 7B:
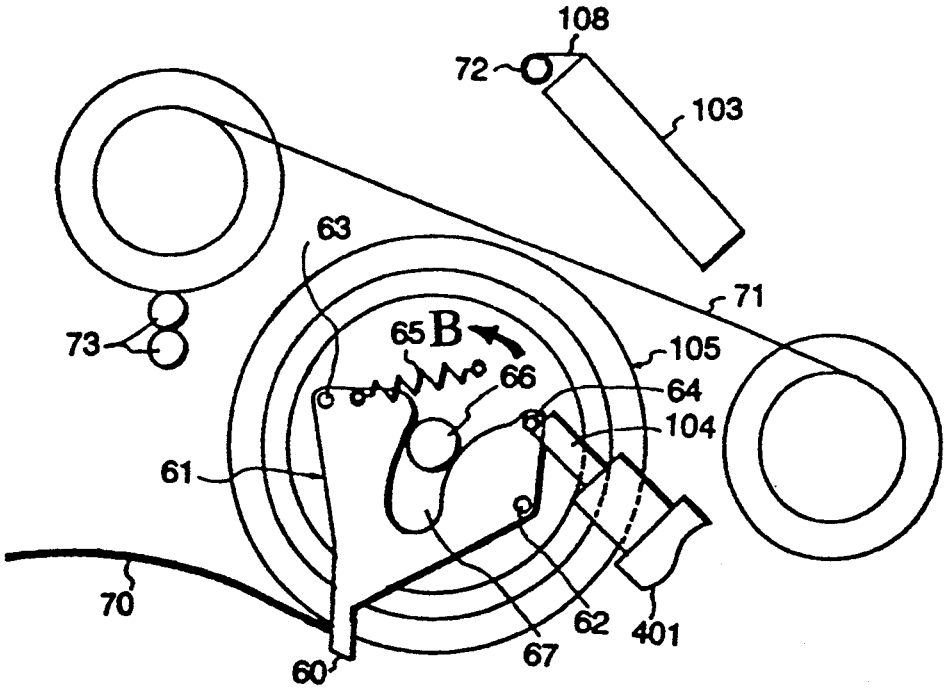

In FIG. 7A, if sensor 101 detects the presence of paper 70 (i.e., the leading edge of a cut-sheet of paper 70) at a supply port SS at the leading edge of paper holder 60, controller 300 drives solenoid 401. Then, as is shown in FIG. 7B, flange 104 of the solenoid pushes each pin 64 (n.b., only one base 107 of drum 105, and thus only one bracket 61 is shown) in the direction of arrow "B" so that bracket 61 rotates around axle 62 in a counter-clockwise direction along the curved recess 67. As is shown in FIG. 7B, paper holder 60 is then forced away from the circumferential surface 107 of platen drum 105 to be spaced apart from the circumferential surface 107 of the platen drum 105 while a leading edge of a sheet of paper 70 is inserted between the paper holder 60 and circumferential surface 107 of drum 105.

Figure 7C:
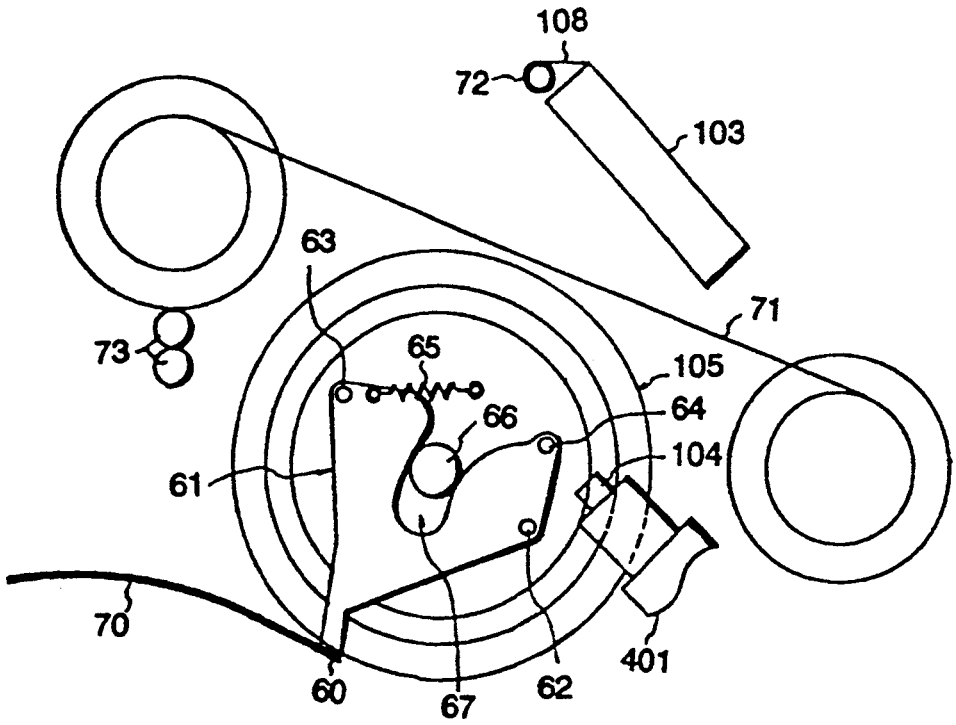

Referring again to FIG. 7B, bracket 61 is rotated in a clockwise direction while being guided along the curved slides of recess 67 by the restoration force of spring 65, and returned to its original position, when an electric current through solenoid 401 is interrupted by a control signal from controller 300. Accordingly, the leading edge of paper 70 is fixed between paper holder 60 and the platen drum 105, as is shown in FIG. 7C (and as is also shown in FIGS. 7D, 7E and 7F).

Thus, drum 105 is rotated in a counter-clockwise direction by a platen drum motor 402 and simultaneously the counter of controller 300 counts printing lines, that is, each line of rotation by platen drum 105 which constitutes one of the 654 possible lines of rotation in single revolution by the circumference of drum 105.

Figure 7D:
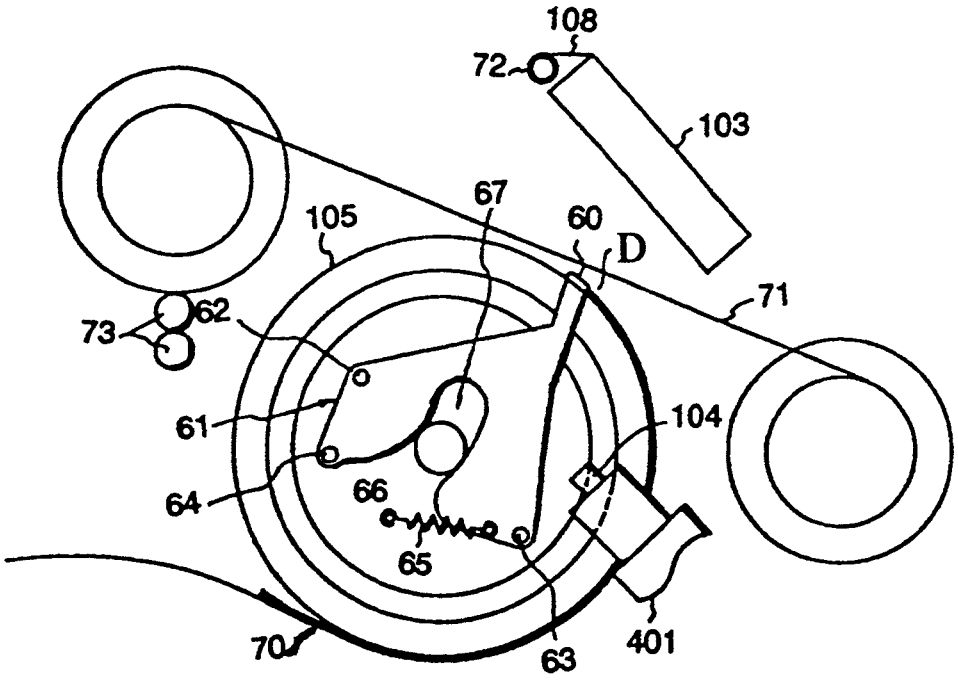
Figure 7E:
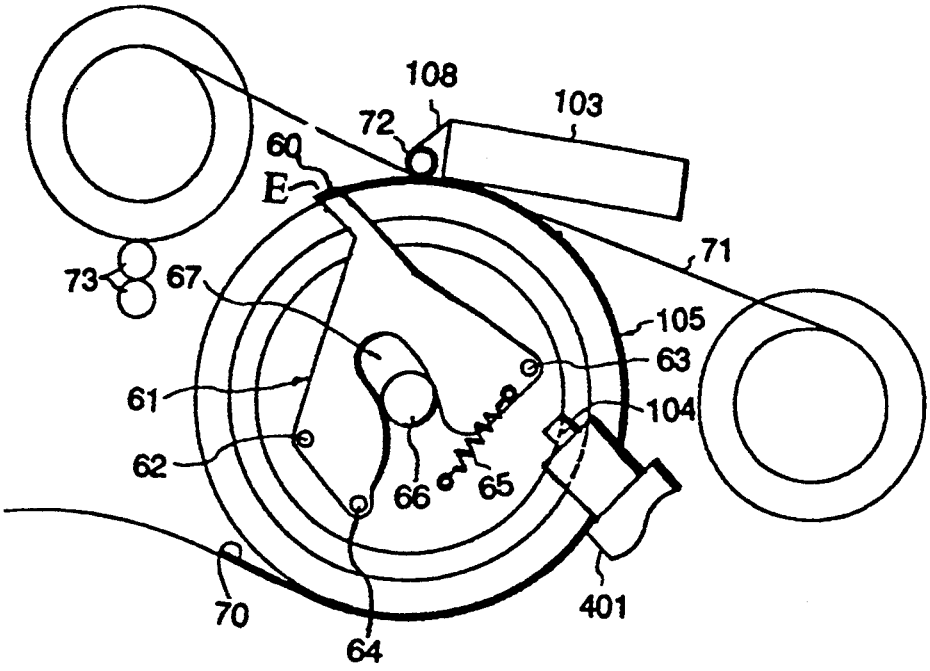
Figure 7F:
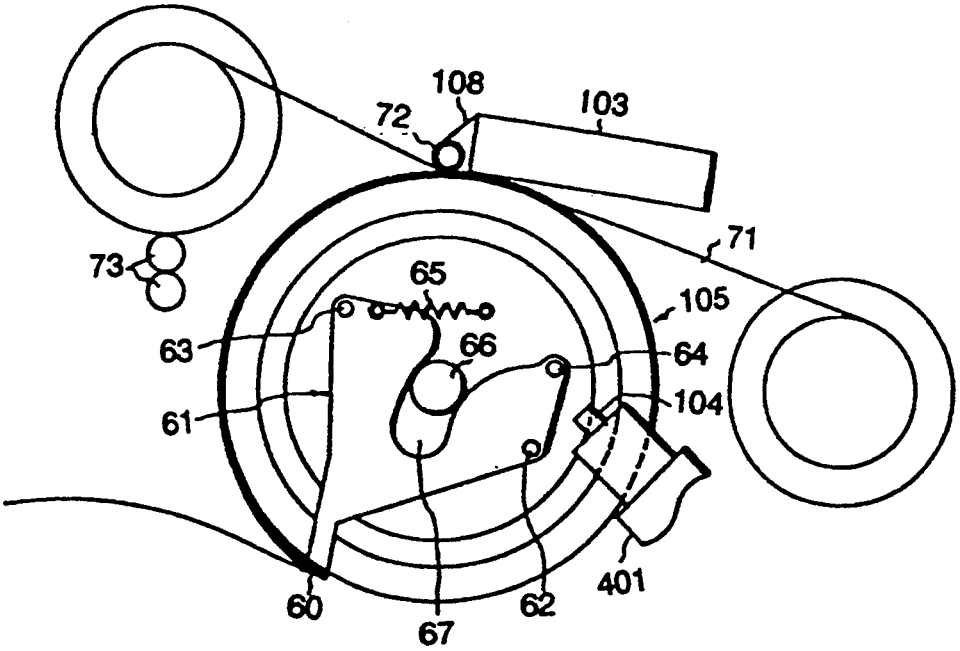

Turning now to FIG. 7D, if a sheet of paper 70 is held by paper holder 60 while platen drum 105 is rotated through 400 lines and the line counter counts by 400 lines, the sheet of paper is delivered to position "D" at which position the line counter indicates 400 lines; rotation of drum 105 is then stopped and the thermal printing head 103 is lifted apart, and separated from, platen drum 105. Thereafter, platen drum 105 is rotated from the first position "D" in a counter-clockwise direction while the line counter counts through 64 lines until paper holder 60 arrives at point "E", at which position the counter indicates 64 lines, as is shown in FIG. 7E. The platen drum stops rotating, and printing head 103 presses multi-color ribbon 71 onto paper 70 under the force supplied by head motor 403 to provide a frictional force between surface 107 and paper 70. Thereafter, platen drum 105 is continuously rotated in a counter-clockwise direction and simultaneously the thermal printing head 103 is heated to sublimate a yellow color dye onto paper 70, with the result that part of the printing operation is performed as is shown in FIG. 7F. The printing operation for one color begins with the count made by the counter of controller 300, and is finished when that counter has counted 512 lines.

When the paper holder 60 is delivered through counter-clockwise rotation of platen drum 105, to point "F" after completion of the printing of the yellow color, as is shown in FIG. 7D, point "F" begins at 512 lines from the start of printing, platen drum 105 stops rotating and thermal printing head 103 is again lifted away from surface 107 separating paper holder 60 from platen drum 105. Platen drum 105 rotates further to deliver the heading edge of paper 70 to point "E" (of 142 lines, i.e., rotation through 78 lines of the bottom margin of each sheet of paper 70 plus rotation through 64 lines of the top margin of the sheet), and thereafter magenta color is printed onto paper 70 by repeating the same operation as is shown in FIGS. 7E and 7F.

Figure 7G:
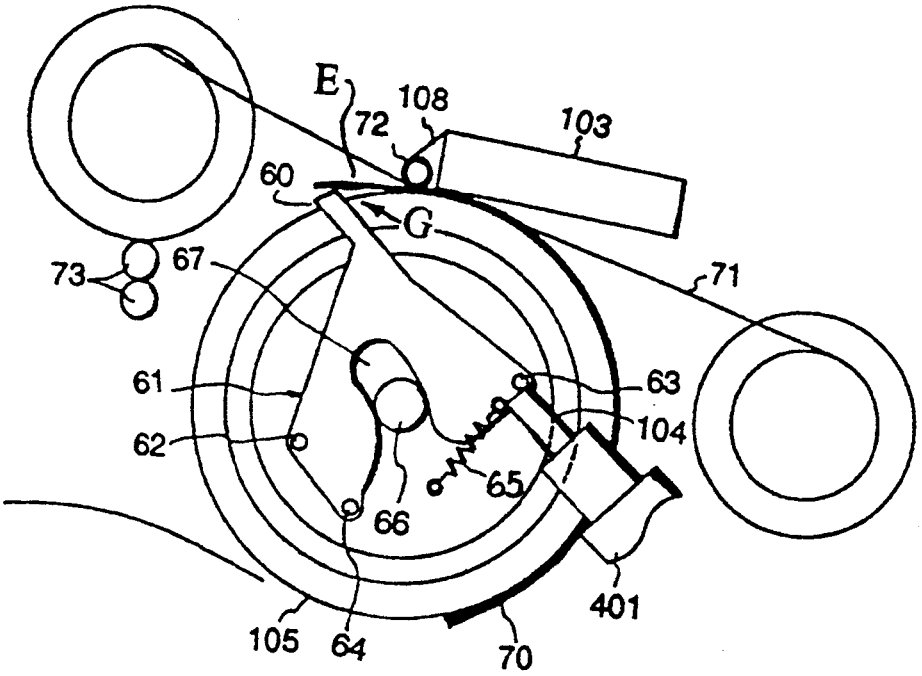

When the paper holder 60 arrives at point "E" after printing the yellow and magenta colors in the foregoing operations, platen drum 105 stops rotating, and head motor 403 causes head 103 to press ribbon 71 against paper 70. Then, head motor 403 stops and solenoid 401 drives flange 104 to engage projecting pin 63. Bracket 61, which is a unitary structure with projecting pin 63 and the paper holder 60, rotates around axle 62 in a counter-clockwise direction so as to move the paper holder 60 from point "E" in the direction of arrow "G". As is shown in FIG. 7G, the leading edge of the partially printed paper 70 (i.e., only yellow and magenta colors have been printed onto paper 70 at this point) is released from paper holder 60 and is lifted by its intrinsic resilient force away from surface 107. At this time, if the electric current of solenoid 401 is interrupted, the restoring force of spring 65 returns the bracket to its original position and paper holder 60 again contacts surface 107 of platen drum 105 while the record paper is outside of paper holder 60, that is, with paper 70 being separated from surface 107 by holder 60 as is shown in FIG. 7H.

Figure 7H:
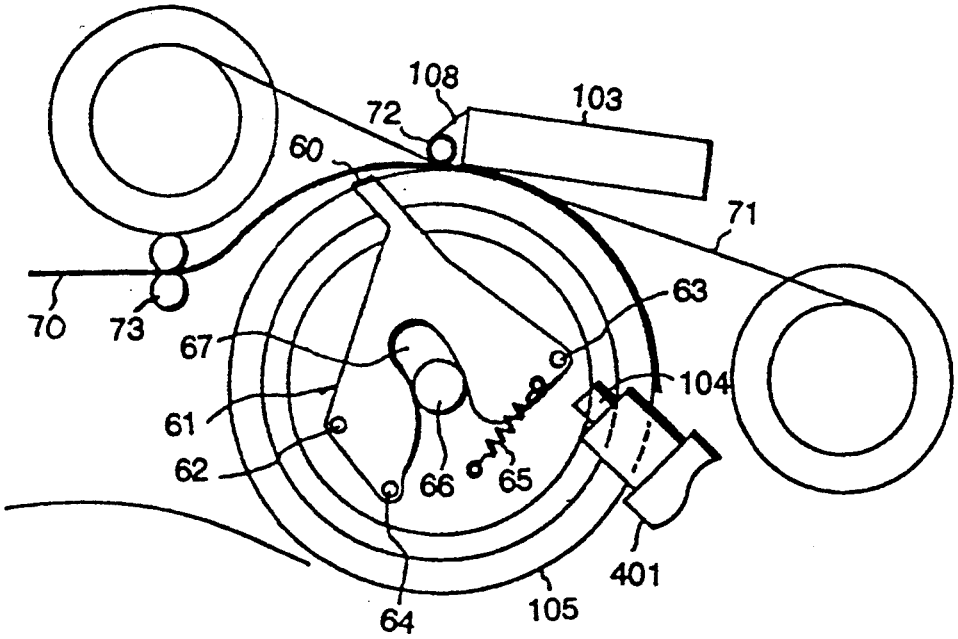

In FIG. 7H, the platen drum 105 continues to rotate for printing the last color, cyan, wherein the partially printed paper 70 upon which only yellow and magenta colors have been printed, is firmly held on the platen drum by the frictional force of roller 72 attached to the distal end of print head 103. A pair of discharging rollers 73 transmits the print-completed (i.e., printed) paper to a discharge tray immediately after completion of the printing of the cyan color component onto paper 70.

Figure 8A:
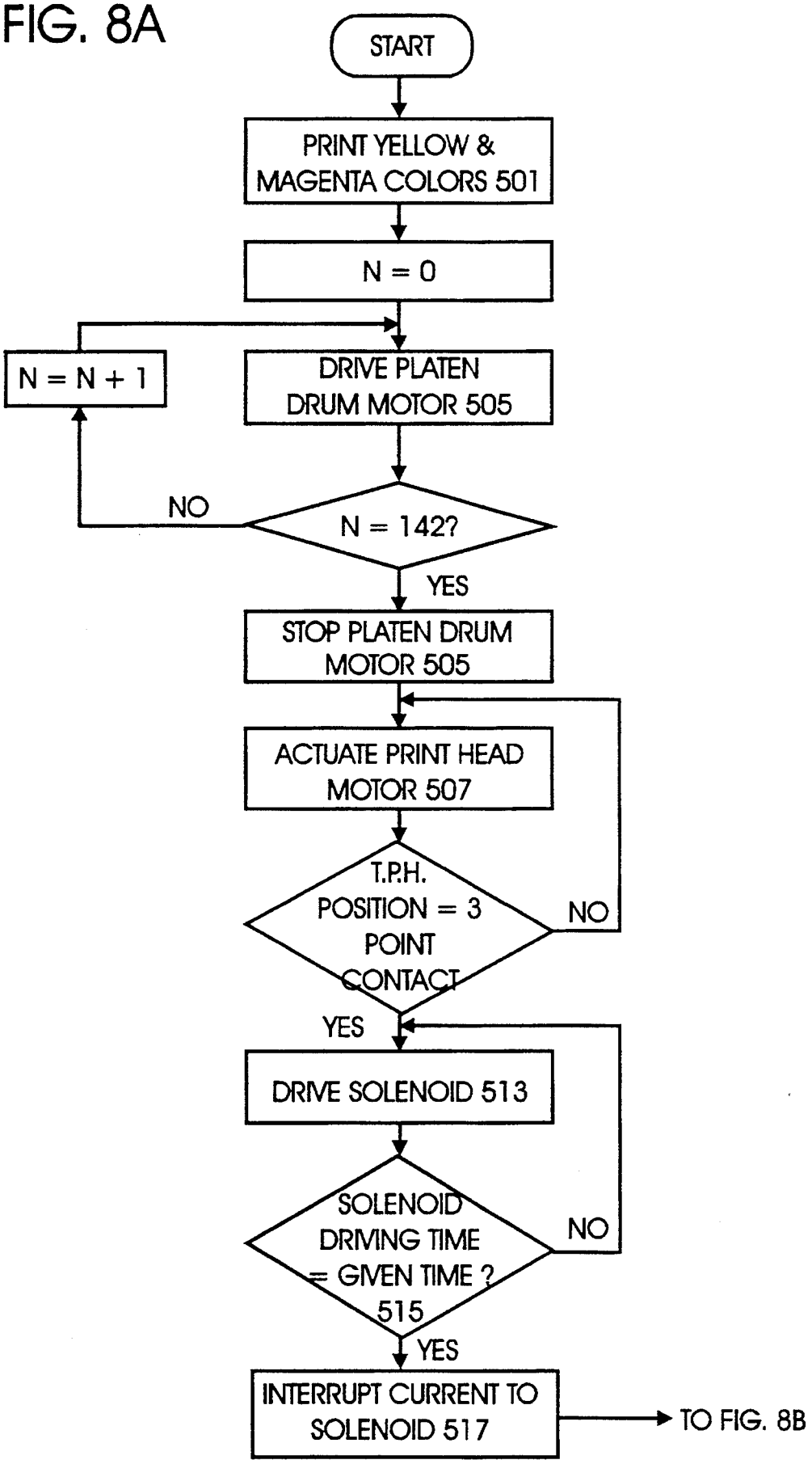
FIGS. 8A and 8B are schematic diagrams illustrating a flow chart for the controller of FIG. 5.
Figure 8B:
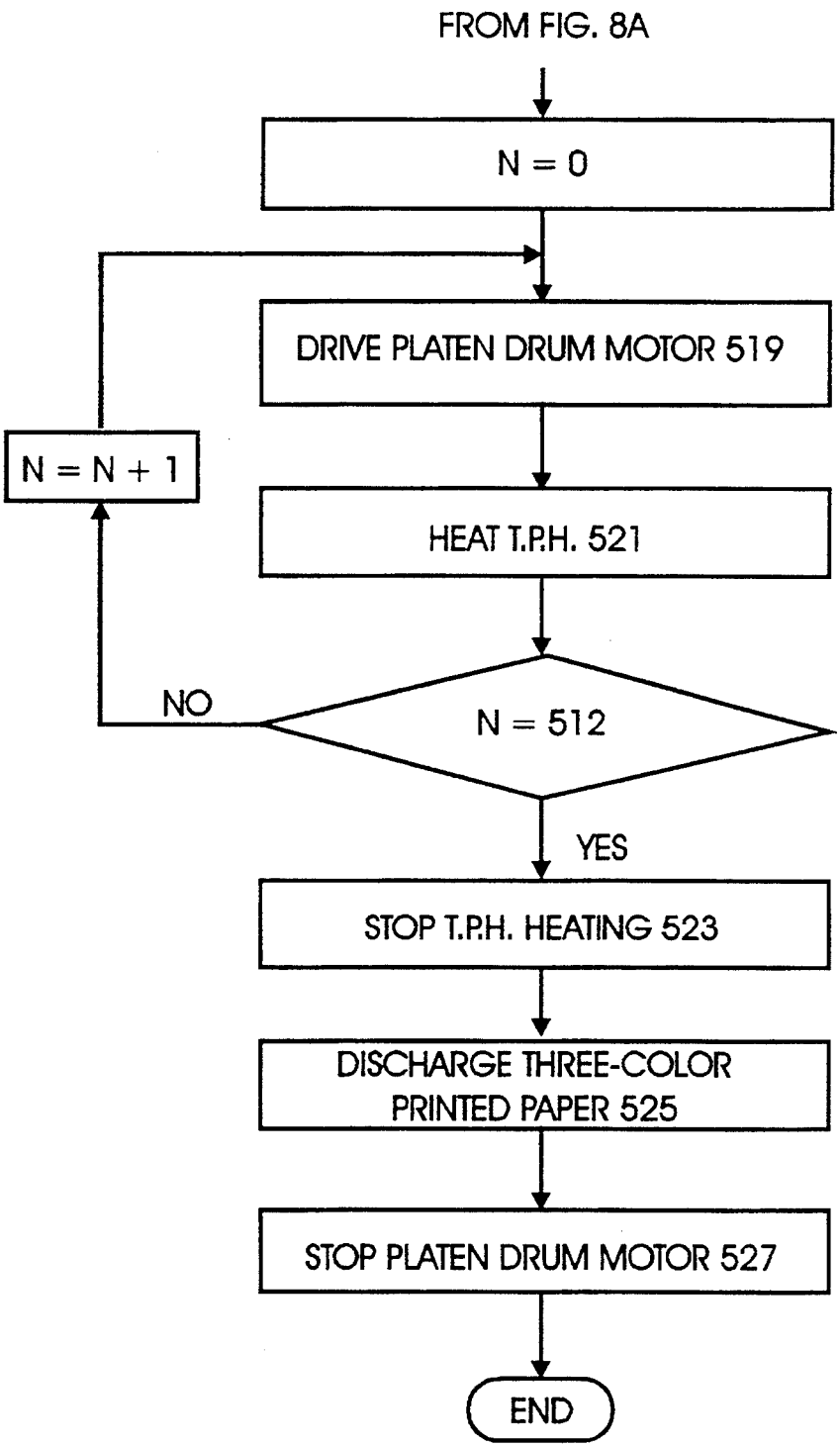

FIGS. 8A and 8B illustrate flow charts of a microcomputer in the controller 300 interpolated into an embodiment of the present invention. After printing of yellow and magenta is completed in step 501, a control signal of logical "high" for driving head motor 403 is produced in order to lift the thermal print head away from the circumferential surface 107 of the platen drum 105. If the head 103 is lifted from the platen drum by a given distance, the control signal goes to a logical "low".

A drum motor control signal with a logical "high" state, for driving the platen drum 402, is produced to move the sheet of paper 70 to an initial printing position of cyan color in step 503. At step 502 the counter of the control part 300 counts the lines simultaneously with step 501. When the count number reaches 142, a control signal of logical "low" is generated by controller 300 and provided to the platen drum motor 402, thereby enabling motor 402 to stop platen drum 105 in step 505. Platen drum 105 and paper holder 60 are located at point "E" of FIG. 7E. Then, if the control signal of logic "high" is provided to head motor 403 in step 507, the head presses paper 70, and ribbon 71 onto the circumferential surface 107 of the platen drum 105 with a given pressure, the head being in a three-point contact position.

If the head 103 is in a three-point contact position in step 509, a control signal of logic "low" is provided to head motor 403, thereby stopping head 103 in step 511 and generally a control signal of logic "high" for solenoid 401 in step 513. Consequently, and as is shown in FIG. 7G, flange 104 rotates bracket 61 so that the paper holder is forced away from the platen drum and the leading edge of paper 70 is released.

If a given time is determined in step 515 to have passed after the control signal of logic "high" is applied to solenoid 401 in step 515, that control signal of logic "high" goes to logic "low" in step 517. Then the electric current through solenoid 401 is interrupted, thereby returning the flange to its original position, releasing the leading edge of paper 70 from platen drum 105 and causing the paper holder to ride upon the circumferential surface 107 of the platen drum 105.

The platen drum rotates counter-clockwise by a control signal of logic "high" applied to the drum motor in step 519, the thermal printing head is heated according to the concentration of the various color components in the picture to print in step 521. Simultaneously, the counter of controller 300 counts the printing lines by 512 lines in step 522. Thereafter, the drum motor and thermal heating of the head are stopped by the controller 300 in step 523. After completion of the printing of the last color, cyan, the print-completed paper is guided by a guide (not shown) to discharge rollers 73, and is discharged right after completion of printing of the last one of the colors, as is shown in FIG. 7H in step 525. Finally, the drum motor is stopped in step 527.

In summary, a process for printing various colors in sequence comprises the steps of positioning a multi-colored ribbon containing a multiplicity of consecutive patterns each comprised of a plurality of distinguishable colors, between a print head and a platen drum. A leading edge of a sheet of paper is inserted between a circumferential surface of a platen drum and a paper holder, and, with the paper holder holding the paper along opposite sides of the paper, the paper is maintained against the platen drum with the opposite sides of the paper positioned between the paper holder and the platen drum. The platen drum is rotated in a first direction to advance the paper to a first position along the platen drum. Rotation of the platen drum is stopped when the leading edge of the paper is delivered to a first position, and the paper is pressed against the platen drum with a print head. The platen drum is rotated in the first direction and the print head is actuated to thereby enable printing of a first one of the plurality of colors in a first one of the patterns from the multi-colored ribbon onto the paper as the platen drum rotates to remove the leading edge of the paper from the first position to the second position. Rotation of the platen drum maybe stopped when the leading edge of the paper arrives at the second position, and the print head lifted away from the ribbon, and the platen drum rotated while the leading edge of the paper is moved from the second position to the first position. Rotation of the platen drum may be stopped when the leading edge of the paper arrives at the second position, and the print head lifted away from the ribbon, and the platen drum rotated while the leading edge of the paper is moved from the second position to the first position. Rotation of the platen drum may be stopped when the leading edge of the paper arrives at the first position. The paper holder is lifted away from the platen drum and the opposite sides of the paper are thereby released from the circumferential surface of the platen drum. The paper holder may be released to return to the circumferential surface of the platen drum while the opposite sides of the paper arc not being maintained against the platen drum by the paper holder. The platen drum is then rotated in the first direction, pressing the paper against the platen drum with the print head and the ribbon, and the print head is actuated to enable printing of the last one of the plurality of colors in the first one of the patterns from the multi-colored ribbon onto the paper to provide a completed color print. The completed color print is discharged after completion of the printing of the last one of the plurality of colors in the first one of the patterns onto the paper.

The arrival of the paper at the first position may be sensed by counting increments of rotation of the platen drum during the step of the platen drum in the first direction to advance the paper to the first position along the platen drum.

After rotating the platen drum in the first direction to advance tile paper to a first position along the platen drum, but before stopping rotation of the platen drum when the leading edge of the paper is delivered to the first position, and before pressing tile paper against the platen drum with the print head, the process may stop rotation of the platen drum and actuated a head motor to lift a print head away from the platen drum and rotate the platen drum in the first direction until the leading edge of the paper is delivered to the first position with the paper disposed between the print head and the platen drum.

The process may actuate the print head to enable the printing of the last one of the plurality of colors in the first one of the patterns from the multi-colored ribbon onto the paper to provide the completed color print while the opposite sides of the paper are not maintained against the platen drum by the paper holder.

In conclusion, the paper holder increases the printing speed by preventing the platen drum from rotating unnecessarily and prevents waste of the ribbon by discharging the printing paper right after completion of the printing of all colors, without a need to either reengage the colored ribbon with the print head to consume an additional length of the ribbon, or to reverse the direction of rotation of the platen drum. Advantageously, the platen drum while rotated in a single direction, transports the paper to be printed from a supply port, through a sequence of multi-colored printing, through disengagement with the paper holder, completion of multi-color printing and discharge without need from rotation in the opposite direction.

The embodiments disclosed in the foregoing paragraphs contemplate the use of sheets of paper with six hundred fifty-four possible lines of rotation, and thus the same number of possible lines of color printing. Actually, it is necessary to have a top and bottom margin for each sheet of paper; the embodiment has been disclosed with an exemplary top margin of sixty-four lines and a bottom margin of seventy-eight lines. Controller 300 may be set by a user to vary either, or both, the top and bottom margins of a sheet of paper. Additionally, controller 300 may be set by a user to vary the number of lines of printing, thereby enabling contoller 300 to terminate printing in response to a different byline count by its internal counter and thus accommodate different sizes of paper in response to the instructions of a user. Consequently, controller 300 may be readily set to accommodate a different size of paper; in one exemplar, sheets of paper with 607 lines of possible rotation were processed with the device and process disclosed.

While the present invention has been shown and described with reference to the preferred embodiment thereof, it will be understood by those skilled in the art that foregoing and other changes in form and detail may be made without departing from the spirit and scope of the present invention. For example, although it is desirable to have separate, spaced-apart paper holders 60*a*, 60*a*, it is possible to construct an embodiment as shown in FIG. 6A, with a single bail extending between brackets 61, 61*a*, to serve as a paper holder 60*a*. Other modifications in accordance with the foregoing principles of the invention disclosed, will be understood by those skilled in the art.

What is claimed is:

1. A process for printing various colors in sequence by using a video printer, comprising the steps of:

inserting a leading edge of a sheet of paper having opposite sides between a circumferential surface of a platen drum and a paper holder, and holding the leading edge along said opposite sides of said sheet of paper;

rotating the platen drum in a counter-clockwise direction to advance the paper to a first position along the platen drum, the first position being sensed by a counter;

stopping rotation of the platen drum and actuating a head motor to lift a thermal print head from the platen drum;

rotating the platen drum in a counter-clockwise direction until the paper is delivered to a second position sensed by the counter;

stopping rotation of the platen drum, and actuating the head motor to impress the paper with the thermal print head;

rotating the platen drum in a counter-clockwise direction and heating the thermal print head to thereby print a first color from a multi-colored ribbon onto the paper until the paper is delivered to the first position;

stopping the platen drum and lifting the thermal print head;

rotating the platen drum to move the paper from the first position to the second position;

stopping the platen drum, applying the thermal print head to press the paper against the platen, and heating the thermal print head while the paper is in the second position, to thereby print a second color from the ribbon onto the paper as the platen drum resumes rotation to move the paper to the first position;

stopping the platen drum and lifting the thermal print head;

rotating the platen drum to move the record paper from the first position to the second position;

stopping rotation of the platen drum and the head motor;

actuating means for lifting the paper holder away from the platen drum at the second position, and thereby releasing the leading edge of the printed paper from the surface of the platen drum;

stopping the actuating means to enable the paper holder to adhere to the platen drum;

rotating the platen drum in a counter-clockwise direction while said thermal print head presses said record paper against said platen drum and heating the thermal print head and thereby printing a final color from the multi-colored ribbon to provide a completed printed paper; and discharging the completed printed paper just after the printing of said final color.

2. A process for printing of various colors in sequence, comprising the steps of:

positioning a multi-colored ribbon containing a multiplicity of consecutive patterns each comprised of a plurality of distinguishable colors, between a thermal print head and a platen drum;

inserting a leading edge of a sheet of paper between a circumferential surface of the platen drum and a paper holder, and, with the paper holder holding the leading edge of the paper along opposite sides of the paper, maintaining the paper against the platen drum with the opposite sides of the paper positioned between the paper holder and the platen drum;

rotating the platen drum in a counter-clockwise direction to advance the paper to a first position along the platen drum;

stopping rotation of the platen drum and actuating a head motor to lift a thermal print head away from the platen drum;

rotating the platen drum in a counter-clockwise direction until the leading edge of the paper is delivered to a second position with the paper disposed between the thermal print head and the platen drum, said second position being separated from said first position by the thermal print head;

stopping rotation of the platen drum when the leading edge of the paper is delivered to the second position, and actuating the head motor to press the paper against the platen drum with the thermal print head;

rotating the platen drum in a counter-clockwise direction and heating the thermal print head, to thereby enable printing of a first one of said plurality of colors in a first one of said patterns from the multi-colored ribbon onto the paper as the platen drum rotates to move the leading edge of the paper from the second position to the first position;

stopping rotation of the platen drum when the leading edge of the paper arrives at the first position and lifting the thermal print head away from the ribbon;

rotating the platen drum to move the leading edge of the paper from the first position to the second position;

stopping rotation of the platen drum when the leading edge of the paper reaches the second position, pressing the paper against the platen drum with the thermal print head;

rotating the platen drum in a counter-clockwise direction and heating the thermal print head, to thereby enable printing of a second one of said plurality of colors in said first one of said patterns from the multi-colored ribbon onto the paper as the platen drum rotates to move the paper from the second position to the first position;

stopping rotation of the platen drum when the leading edge of the paper arrives at the first position and lifting the thermal print head away from the ribbon;

rotating the platen drum to move the leading edge of the paper from the first position to the second position;

stopping rotation of the platen drum when the leading edge of the paper arrives at the second position:

actuating means for lifting the paper holder away from the platen drum at the second position, and thereby releasing the leading edge of the paper from the circumferential surface of the platen drum;

releasing the paper holder to return to the circumferential surface of the platen drum while the opposite sides of the leading edge of the paper are not maintained against the platen drum by the paper holder;

rotating the platen drum in a counter-clockwise direction, actuating the head motor to press the paper against the platen drum with the thermal print head and the ribbon and heating the thermal print head, to thereby print a final one of said plurality of colors in said first one: of said patterns from the multi-colored ribbon onto the paper to provide a completed color print; and discharging the completed color print after printing said final one of said plurality of colors in said first one of said patterns onto the paper.

3. The process of claim 2, further comprised of sensing arrival of the paper at said first position by counting increments of rotation of the platen drum during said step of rotating the platen drum in a counter-clockwise direction to advance the paper to said first position along the platen drum.

4. A process for printing of various colors in sequence, comprising the steps of:

positioning a multi-colored ribbon containing a multiplicity of consecutive patterns each comprised of a plurality of distinguishable colors, between a print head and a platen drum;

inserting a leading edge of a sheet of paper between a circumferential surface of the platen drum and a paper holder, and, with the paper holder holding the leading edge of the paper along opposite sides of the paper, maintaining the paper against the platen drum with the opposite sides of the paper positioned between the paper holder and the platen drum;

rotating the platen drum in a first direction to advance the paper to a first position along the platen drum;

stopping rotation of the platen drum when the leading edge of the paper is delivered to the first position, and pressing the paper against the platen drum with the print head;

rotating the platen drum in said first direction and actuating the print head to thereby enable printing of a first one of said plurality of colors in a first one of said patterns from the multi-colored ribbon onto the paper as the platen drum rotates to move the leading edge of the paper from the first position to the second position;

stopping rotation of the platen drum when the leading edge of the piper arrives at the second position and lifting the print head away from the ribbon;

rotating the platen drum to move the leading edge of the paper from the second position to the first position;

stopping rotation of the platen drum when the leading edge of the paper reaches the first position, pressing the paper against the platen drum with the print head;

rotating the platen drum in said first direction and actuating the print head, to thereby enable printing of a second one of said plurality of colors in said first one of said patterns from the multi-colored ribbon onto the paper as the platen drum rotates to move the paper from the first position to the second position;

stopping rotation of the platen drum when the leading edge of the paper arrives at the second position and lifting the print head away from the ribbon;

rotating the platen drum to move the leading edge of the paper from the second position to the first position;

stopping rotation of the platen drum when the leading edge of the paper arrives at the first position;

lifting the paper holder away from the platen drum at the first position, and thereby releasing the leading edge of the paper from the circumferential surface of the platen drum;

releasing the paper holder to return to the circumferential surface of the platen drum while the opposite sides of the leading edge of the paper are not maintained against the platen drum by the paper holder;

rotating the platen drum in said first direction, pressing the paper again:it the platen drum with the print head and the ribbon, and actuating the print head to thereby print a final one of said plurality of colors in said first one of said patterns from the multi-colored ribbon onto the paper to provide a completed color print: and discharging the completed color print after printing said final one of said plurality of colors in said first one of said patterns onto the paper.

5. The process of claim 4, further comprised of sensing arrival of the paper at said first position by counting increments of rotation of the platen drum during said step of rotating the platen drum in said first direction to advance the paper to said first position along the platen drum.

6. The process of claim 4, further comprised of after rotating the platen drum in said first direction to advance the paper to a first position along the platen drum, but before stopping rotation of the platen drum when the leading edge of the paper is delivered to the first position, and before pressing the paper against the platen drum with the print head:

stopping rotation of the platen drum and actuating a head motor to lift the print head away from the platen drum; and rotating the platen drum in said first direction until the leading edge of the paper is delivered to the first position with the paper disposed between the print head and the platen drum.

7. A process for printing of various colors in sequence, comprising the steps of:

positioning a multi-colored ribbon containing a multiplicity of consecutive patterns each comprised of a plurality of distinguishable colors, between a print head and a platen drum;

inserting a leading edge of a sheet of paper between a circumferential surface of the platen drum and a paper holder, and, with the paper holder holding the leading edge of the paper along opposite sides of the paper, maintaining the paper against the platen drum with the opposite sides of the paper positioned between the paper holder and the platen drum;

rotating the platen drum in a first direction to advance the paper to a first position along the platen drum;

stopping rotation of the platen drum when the leading edge of the paper, is delivered to the first position, and pressing the paper against the platen drum with the print head;

rotating the platen drum in said first direction and actuating the print head to thereby enable printing of a first one of said plurality of colors in a first one of said patterns from the multi-colored ribbon onto the paper as the platen drum rotates to move the leading edge of the paper from the first position to the second position;

stopping rotation of the platen drum when the leading edge of the paper arrives at the second position and lifting the print head away from the ribbon;

rotating the platen drum to move the leading edge of the paper from the second position to the first position;

stopping rotation of the platen drum when the leading edge of the paper arrives at the first position;

lifting the paper holder away from the platen drum at the first position and thereby releasing the leading edge of the paper from the circumferential surface of the platen drum:

releasing the paper holder to return to the circumferential surface of the platen drum while the opposite sides of the leading edge of the paper are not maintained against the platen drum by the paper holder;

rotating the platen drum in said first direction, pressing the paper against the platen drum with the print head and the ribbon, and actuating the print head to thereby print a final one of said plurality of colors in said first one of said patterns from the multi-colored ribbon onto the paper to provide a completed color print; and discharging the completed color print after printing said final one of said plurality of colors in said first one of said patterns onto the paper.

8. The process of claim 7, further comprised of sensing arrival of the paper at said first position by counting increments of rotation of the platen drum during said step of rotating the platen drum in said first direction to advance the paper to said first position along the platen drum.

9. The process of claim 7, further comprised of after rotating the platen drum in said first direction to advance the paper to a first position along the platen drum, but before stopping rotation of the platen drum when the leading edge of the paper is delivered to the first position, and before pressing the paper against the platen drum with the print head:

stopping rotation of the platen drum and actuating a head motor to lift the print head away from the platen drum; and rotating the platen drum in said first direction until the leading edge of the paper is delivered to the first position with the paper disposed between the print head and the platen drum.

10. A device enabling printing of various colors in sequence, comprising:

an axle coaxially positionable to extend axially outwardly from axially opposite bases of a platen drum providing a circumferential outer surface disposed between the opposite bases, said axle having circumferential grooves terminated by corresponding flanges;

a pair of brackets each having first, second and third arms joined together in a unitary monolithic structure with said first and second arms defining a centrally disposed recess having spaced-apart curved sides positioned to ride along corresponding ones of said circumferential grooves, pivoting means for pivotally connecting said second arms to the opposite bases of the platen drum, and means for holding edges of sheets of paper against the circumferential outer surface projecting axially inwardly from distal ends of said third arms across the circumferential outer surface: and means for biasing each of said pair of brackets toward a first orientation relative to said pivoting means.

11. The device of claim 10, wherein said bracket further comprises means located at a position approximately diametrically opposite said axle form said pivoting means, for coupling said biasing means to said bracket.

12. The device of claim 11, further comprised of:

means for engaging one of said first and second arms while in a first operational mode, and for causing rotation of said brackets from said first orientation where said holding means engages the circumferential surface, and around said pivoting means relative to said opposite bases, to a second orientation where said holding means is spaced apart from said circumferential surface.

13. The device of claim 12, further comprised of said curved sides defining arcs of different radii having centers substantially coincidental with said pivoting means.

14. The device of claim 13, further comprised of said holding means defining an arc having a center substantially coincidental with said pivoting means and a radius greater than said different radii, as said holding means travels from said first orientation to said second orientation.

15. The device of claim 12, further comprised of said holding means being spaced apart from said pivoting means, and positioned to travel along an arc spaced-apart from said pivoting means from said first orientation to said second orientation.

16. The device of claim 12, further comprised of:

means for engaging one of said first and second arms while in a first operational mode, and for simultaneously causing radial displacement and rotation of said brackets from said first orientation where said holding means engages the circumferential surface, and around said pivoting means relative to said opposite bases, to a second orientation where said holding means is spaced apart from said circumferential surface.

17. The device of claim 11, further comprised of said holding means being spaced apart from said pivoting means, and positioned to travel along an arc spaced-apart from said pivoting means from a first position engaging edges of the circumferential outer surface to a second position arcuately spaced-apart from the circumferential surface.

18. The device of claim 10, further comprised of:

means for engaging one of said first and second arms while in a first operational mode, and for causing rotation of said brackets from said first orientation where said holding means engages the circumferential surface, and around said pivoting means relative to said opposite bases, to a second orientation where said holding means is spaced apart from said circumferential surface.

19. The device of claim 18, further comprised of said curved sides defining arcs of different radii having centers substantially coincidental with said pivoting means.

20. The device of claim 19, further comprised of said holding means defining an arc having a center substantially coincidental with said pivoting means and a radius greater than said different radii, as said holding means travels from said first orientation where said holding means engages the circumferential surface, and around said pivoting means relative to said opposite bases, to a second orientation where said holding means is spaced apart from said circumferential surface.

21. The device of claim 18, further comprised of said curved sides defining arcs of different radii having centers substantially coincidental with said pivoting means.

22. The device of claim 21, further comprised of said holding means defining an arc having a center substantially coincidental with said pivoting means and a radius greater than said different radii, as said holding means travels from said first orientation to said second orientation.

23. The device of claim 18, further comprised of said holding means being spaced apart from said pivoting means, and positioned to travel along an arc spaced-apart from said pivoting means from said first orientation to said second orientation.

24. The device of claim 23, wherein said holding means comprises a bail attached to and extending between said pair of brackets across said circumferential surface.

25. The device of claim 23, wherein said holding means comprises a projection forming a distal terminal end of said third arm of corresponding ones of said brackets.

26. The device of claim 18, further comprised of:

means for rotating the platen drum;

means for positioning the print head while the print head is separated from the platen drum by a multi-colored ribbon containing a multiplicity of consecutive patterns each comprised of a plurality of distinguishable colors; and means for controlling said engaging means, said rotating means and said positioning means, said controlling means:

actuating said engaging means to cause said rotation frown said first orientation to said second orientation to enable insertion of a leading edge of a sheet of paper between a side surface of the platen drum and a paper holder, and, with the paper holder holding the paper along opposite sides of the paper, and to release said brackets to return from said second orientation to said first orientation while maintaining the paper against the platen drum with the opposite sides of the paper positioned between the paper holder and the platen drum;

enabling said rotating means to rotate the platen drum in a first direction to advance the paper to a first position along the platen drum;

controlling said rotating means to stop rotation of the platen drum when the leading edge of the paper is delivered to the first position, and actuating said positioning means to press the paper against the platen drum with the print head;

enabling said rotating means to rotate the platen drum in said first direction and actuating the print head to thereby enable printing of a first one of said plurality of colors in a first one of said patterns from the multi-colored ribbon onto the paper as the platen drum rotates to move the leading edge of the paper from the first position to the second position;

controlling said rotating means to stop rotation of the platen drum when the leading edge of the paper arrives at the second position, controlling said positioning means to lift the print head away from the ribbon, and actuating said rotating means to rotate the platen drum to move the leading edge of the paper from the second position to the first position;

controlling said rotating means to stop rotation of the platen drum when the leading edge of the paper arrives at the first position;

actuating said engaging means to lift the paper holder away from the pinten drum at the first position, and to thereby release the opposite sides of the paper from the circumferential surface of the platen drum;

controlling said engaging means to release the paper holder to return to the circumferential surface of the platen drum while the opposite sides of the paper are not maintained against the platen drum by the paper holder;

actuating said rotating means to rotate the platen drum in said first direction, while actuating said positioning means to press the paper against the platen drum with the print head and the ribbon, and actuating the print head to thereby enable printing of a final one of said plurality of colors in said first one of said patterns from the multi-colored ribbon onto the paper to provide a completed color print while the opposite sides of the paper arc not maintained against the platen drum by the paper holder.

27. The device of claim 26, further comprised of said controlling means enabling said rotating means to rotate said platen drum only in said first direction.

28. A device for enabling printing of various colors in sequence as claimed in claim 26, further comprised of paper feeding means to feed said sheets of paper to said means for holding edges of sheets of paper.

29. A device for enabling printing of various colors in sequence as claimed in claim 26, further comprised of discharging means positioned to discharge said sheets of paper during said printing of said final one of said plurality of colors.

30. The device of claim 18, further comprised of:

means for engaging one of said first and second arms while in a first operational mode, and for simultaneously causing radial displacement and rotation of said brackets from said first orientation where said holding means engages the circumferential surface, and .around said pivoting means relative to said opposite bases, to a second orientation where said holding means is spaced apart from said circumferential surface.

31. The device of claim 10, further comprised of said curved sides defining arcs of different radii having centers substantially coincidental with said pivoting means.

32. The device of claim 31, further comprised of said holding means defining an arc having a center substantially coincidental with said pivoting means and a radius greater than said different radii, as said holding means travels from said first orientation where said holding means engages the circumferential surface, and around said pivoting means relative to said opposite bases, to a second orientation where said holding means is spaced apart from said circumferential surface.

33. The device of claim 10, further comprised of said holding means being spaced apart from said pivoting means, and positioned to travel along an arc spaced-apart from said pivoting means from a first position engaging edges of the circumferential outer surface to a second position arcuately spaced-apart from the circumferential surface.

34. The device of claim 10, wherein said holding means comprises a bail attached to and extending between said pair of brackets across said circumferential surface.

35. The device of claim 10, wherein said holding means comprises a projection forming a distal terminal end of said third arm of each of said brackets.

36. A device for enabling printing of various colors in sequence as claimed in claim 10, further comprised of paper feeding means to feed said sheets of paper to said means for holding edges of sheets of paper.

37. A device for enabling printing of various colors in sequence as claimed in claim 10, further comprised of discharging means positioned to discharge said sheets of paper.

38. A device enabling printing of various colors in sequence, comprising:

a platen drum having a circumferential exterior surface and an axle coaxially extending axially outwardly from said platen drum;

means for feeding paper to said platen drum;

holding means pivotally attached to said platen drum for holding the paper onto said platen drum, comprising a bracket having first and second arms joined together to define a centrally disposed accurately curved recess having spaced-apart curved sides positioned to ride along said axle, biasing means for biasing said holding means to rest upon said platen drum and disengagement means for pivoting said holding means to enable said spaced-apart curved sides to travel accurately along said axle such that said holding means releases the paper;

a thermal print head disposed to engage said circumferential surface of said platen drum;

means for positioning an ink bearing ribbon between said circumferential surface and said thermal print head; and discharging means positioned for receiving paper from said platen drum and discharging the paper from said platen drum during printing of a final one of a plurality of colors from the ink ribbon by the thermal print head onto the paper.

39. A device enabling printing of various colors in sequence, comprising:

a platen drum comprising a circumferential exterior surface and an axles extending axially outwardly from said platen drum;

means for feeding paper to said platen drum;

holding means pivotally attached to said platen drum for holding the paper onto said platen drum, comprising a bracket having first and second arms joined together to define an accurately curved recess having spaced-apart curved sides positioned to ride along said axle, biasing means for biasing said holding means to rest upon said platen drum and disengagement means for pivoting said holding means to enable said spaced-apart curved sides to travel accurately along said axle and against force applied by said biasing means such that said holding means releases the paper;

a thermal print head disposed to engage said circumferential surface of said platen drum;

means for positioning an ink bearing ribbon between said circumferential surface and said thermal print head;

means for holding paper against said platen drum during printing of the paper by actuating said thermal print head to impart ink from the ink ribbon onto the paper; and discharging means positioned for receiving paper from the platen drum and discharging the paper from said platen drum during printing of a final one of a plurality of colors from the ink ribbon by the thermal print head onto the paper.

40. A process for printing various colors in sequence by using a video printer, comprising the steps of:

inserting a leading edge of a sheet of paper having opposite sides between a circumferential surface of a platen drum and a paper holder, and holding the leading edge along said opposite sides of said sheet of paper;

rotating the platen drum in a counter-clockwise direction to advance the paper to a first position along the platen drum, the first position being sensed by a counter;

stopping rotation of the platen drum and actuating a head motor to lift a thermal print head from the platen drum;

rotating the platen drum in a counter-clockwise direction until the paper is delivered to a second position sensed by the counter;

stopping rotation of the platen drum, and actuating the head motor to impress the paper with the thermal print head;

rotating the platen drum in a counter-clockwise direction and heating the thermal print head to thereby print a first color from a multi-colored ribbon onto the paper until the paper is delivered to the first position;

stopping the platen drum and lifting the thermal print head;

rotating the platen drum to move the paper from the first position to the second position;

stopping the platen drum, applying the thermal print head to press the paper against the platen, and heating the thermal print head while the paper is in the second position, to thereby print a second color from the ribbon onto the paper as the platen drum resumes rotation to move the paper to the first position;

stopping the platen drum and lifting the thermal print head;

rotating the platen drum to move the record paper from the first position to the second position;

stopping rotation of the platen drum and the head motor;

actuating means for lifting the paper holder away from the platen drum at the second position, and thereby releasing the leading edge of the printed paper from the surface the platen drum;

stopping the actuating means to enable the paper holder to adhere to the platen drum rotating the platen drum in a counter-clockwise direction while said thermal print head presses said record paper against said platen drum and heating the thermal print head and thereby printing a final color from the multi-colored ribbon to provide a completed printed page; and discharging the completed printed paper during the printing of said final color.

* * * * *